US007963748B2

(12) United States Patent
Taniguchi et al.

(10) Patent No.: US 7,963,748 B2
(45) Date of Patent: Jun. 21, 2011

(54) CENTRIFUGAL AIR COMPRESSOR

(75) Inventors: Manabu Taniguchi, Kashihara (JP); Hirochika Ueyama, Hirakata (JP); Yasukata Miyagawa, Habikino (JP)

(73) Assignee: Jtekt Corporation, Osaka-shi (JP)

( * ) Notice: Subject to any disclaimer, the term of this patent is extended or adjusted under 35 U.S.C. 154(b) by 655 days.

(21) Appl. No.: 12/035,160

(22) Filed: Feb. 21, 2008

(65) Prior Publication Data

US 2008/0292469 A1 Nov. 27, 2008

(30) Foreign Application Priority Data

Feb. 23, 2007 (JP) ..... 2007-044528

(51) Int. Cl.
*F04B 49/00* (2006.01)

(52) U.S. Cl. ..... 417/18; 417/44.1; 417/423.12

(58) Field of Classification Search ..... 417/18, 417/44.1, 423.4, 423.12, 423.14, 423.15
See application file for complete search history.

(56) References Cited

U.S. PATENT DOCUMENTS 5,857,348 A * 1/1999 Conry ..... 62/209
6,435,847 B2 * 8/2002 Kubo et al. ..... 417/423.4
2005/0042118 A1 * 2/2005 Sekiguchi et al. ..... 417/423.4
2007/0069597 A1 3/2007 Taniguchi et al.
2007/0072021 A1 3/2007 Taniguchi et al.
2007/0164626 A1 7/2007 Taniguchi et al.
2007/0246002 A1 10/2007 Taniguchi et al.

FOREIGN PATENT DOCUMENTS

JP 4-287896 10/1992

OTHER PUBLICATIONS

U.S. Appl. No. 12/035,160, filed Feb. 21, 2008, Taniguchi, et al.

* cited by examiner

*Primary Examiner* — Devon C Kramer
*Assistant Examiner* — Peter J Bertheaud
(74) *Attorney, Agent, or Firm* — Oblon, Spivak, McClelland, Maier & Neustadt, L.L.P.

(57) ABSTRACT

If the ambient temperature of a pressure volute measured by a temperature sensor exceeds 0° C., a compressor is instantly started at normal operation. If the temperature of the pressure volute measured by the temperature sensor is 0° C. or lower, vibration along the axial direction is given to the rotary shaft by way of an axial magnetic bearing. If the vibration amplitude of the thus given vibration exceeds a predetermined value, the compressor is started at normal operation after idle operation. On the other hand, if the vibration amplitude is lower than a predetermined value, the heater is actuated to heat the pressure volute only for a predetermined time. Thereafter, the ambient temperature is detected again, and if the ambient temperature exceeds 0° C., the compressor is started.

6 Claims, 2 Drawing Sheets

CENTRIFUGAL AIR COMPRESSOR

This application is based on and claims priority from Japanese Patent Application No. 2007-044528 filed on Feb. 23, 2007, the entire contents of which are incorporated herein by reference.

BACKGROUND OF THE INVENTION

The present invention relates to a centrifugal air compressor, which is provided with a rotary shaft supported by a magnetic bearing and a rotary vane that is encompassed by a pressure volute while being connected to the rotary shaft.

As is well known, centrifugal air compressors are structured so as to compress intake air by rotating rotary vanes. Therefore, a rotary shaft for rotating the rotary vanes must be supported by a structure capable of withstanding high-speed rotation. Many of the thus structured centrifugal air compressors adopt a magnetic bearing capable of supporting the rotary shaft in a non-contact manner as a bearing system for supporting the rotary shaft.

Some of these compressors are used outdoors, for example, as on-vehicle compressors. In this instance, ambient temperatures are in a very wide range from −40° C. to 80° C. In an environment where temperatures are 0° C. or lower, moisture contained in outside air freezes up in a narrow clearance between a rotary vane and the inner wall of a pressure volute, and the rotary vane can be adhered to the pressure volute due to the congelation. The above situation is also found in a case where compressors are used in those of radiators and refrigerators/freezers.

For example, Japanese Laid-Open Patent Publication No. 4-287896 discloses a pump in which, if a rotor is adhered to other members by deposits, a magnetic bearing is used to vibrate the rotor forcibly, thereby releasing the rotor from the adhesion.

In the pump described in Japanese Published Laid-Open Patent Publication No. 4-287896, even with a gas high in reactivity, if there is a deposit substance contained in the gas exhausted from a discharge system for etching apparatus used in semiconductor manufacturing, adhesion of a rotor is highly likely to be eliminated by forcibly vibrating the rotor by use of a magnetic bearing. However, in the case where a rotary vane is adhered to a pressure volute due to a congelation, the state of which is closer to coagulation than deposition, it is less likely that adhesion of a rotary vane is eliminated through vibration by a magnetic bearing. In the case where adhesion of a rotary vane cannot be reliably eliminated, the starting performance of the centrifugal air compressors is significantly degraded.

SUMMARY OF THE INVENTION

An objective of the present invention is to provide a centrifugal air compressor that eliminates adhesion of a rotary vane due to a congelation, thereby allowing the rotary vane to be stably started.

To achieve the foregoing objective and in accordance with one aspect of the present invention, a centrifugal air compressor including a rotary shaft, a rotary vane, a pressure volute, and a suction port is provided. The rotary shaft is supported by a magnetic bearing having electromagnets. The rotary vane is connected to the rotary shaft. The pressure volute encompasses the rotary vane and also compresses air. The suction port draws air into the pressure volute. Air drawn in through the suction port into the pressure volute is compressed by rotation of the rotary vane. The centrifugal air compressor further includes heating means and a controller. The heating means heats at least one of the pressure volute and the rotary vane. The controller controls the operation of the centrifugal air compressor. The controller supplies electricity to the electromagnets of the magnetic bearing at the time of starting the operation of the centrifugal air compressor, thereby giving vibration to the rotary shaft and starting the operation of the centrifugal air compressor if the vibration amplitude of the rotary shaft exceeds a predetermined amplitude value.

DETAILED DESCRIPTION OF THE PREFERRED EMBODIMENTS

A centrifugal air compressor according to one embodiment of the present invention will now be described with reference to FIGS. 1 and 2.

Figure 1:
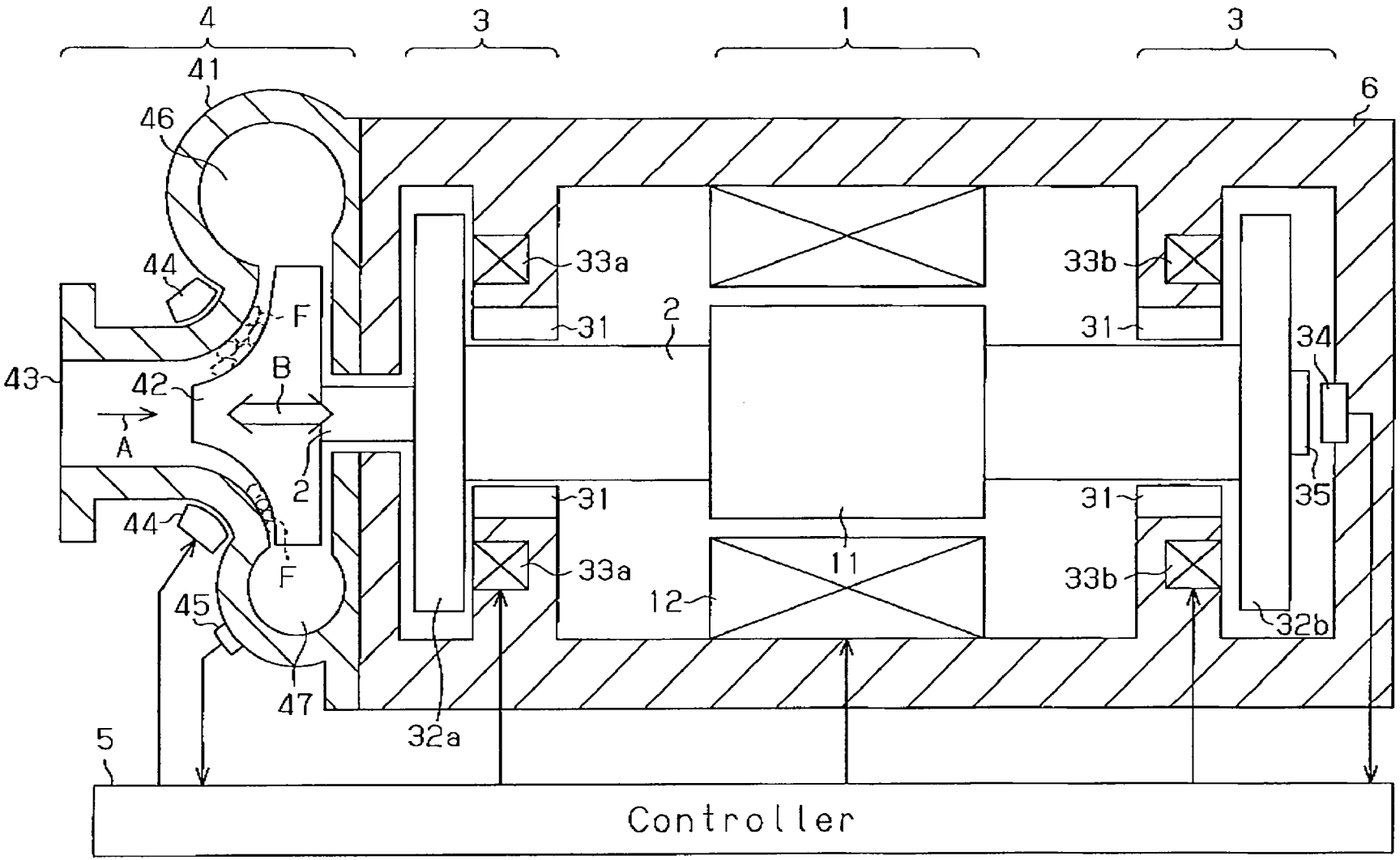
FIG. 1 is a cross-sectional view and block diagram of a centrifugal air compressor according to one embodiment of the present invention.

As shown in FIG. 1, the centrifugal air compressor of the present embodiment is provided with a motor 1 accommodated in a housing 6, a rotary shaft 2 rotated by the motor 1, bearing devices 3 for supporting the rotary shaft 2, a compressor portion 4, and a controller 5. The controller 5 is composed of a microcomputer or a DSP (digital signal processor), and a driving circuit, and controls the overall operation of the compressor. Hereinafter, a detailed explanation will be made for the constitution and functions of each portion.

The motor 1 is provided with a rotor 11 fixed to the rotary shaft 2 and a stator 12 installed at the housing 6 so as to encompass the rotor 11. During normal operation, electricity is supplied to the stator 12 through the controller 5, thereby generating an electromagnetic force, The rotor 11 is rotated together with the rotary shaft 2 by the electromagnetic force.

Each bearing device 3 is provided with a radial foil bearing 31 for supporting the rotary shaft 2 in the radial direction and an axial magnetic bearing for supporting the rotary shaft 2 in the axial direction.

The radial foil bearings 31 allow the rotary shaft 2 to float via gaseous films formed by high-speed rotation of the rotary shaft 2, thereby radially supporting the rotary shaft 2 in a non-contact state when a compressor is operated normally. The axial magnetic bearing is provided with a pair of axial disks 32*a*, 32*b*, a pair of electromagnets 33*a*, 33*b* installed opposing each inner side of the pair of axial disks 32*a*, 32*b*, an axial displacement sensor 34 and a sensor target 35. Each of the axial disks 32*a*, 32*b* is made of a magnetic body and attached to the rotary shaft 2 while being separated from each other. A pair of electromagnets 33*a*, 33*b* pull the axial disks 32*a*, 32*b* in opposite directions, thereby supporting the rotary shaft 2 in the axial direction in a non-contact state. In this instance, the axial displacement sensor 34 constantly monitors the position of the sensor target 35. The controller 5 carries out a feedback control by which the magnetic force of the electromagnets 33*a*, 33*b* is changed in such a manner that the position of the rotary shaft 2 is immediately returned to a predetermined position upon change of the rotary shaft 2 in the axial direction.

The compressor portion 4 is provided with a pressure volute 41 for compressing air internally and a rotary vane 42 encompassed by the pressure volute 41. The rotary vane 42 is connected to the rotary shaft 2 supported by the bearing devices 3. The pressure volute 41 is provided with a suction port 43, an introduction passage 46, a discharge passage 47, and a discharge port (not shown). When the rotary vane 42 is rotated according to the rotation of the rotary shaft 2, outside air is introduced into the compressor portion 4 through the suction port 43 along the direction shown in arrow A of the drawing. The thus introduced outside air is compressed while passing through the introduction passage 46 and the discharge passage 47, and exhausted as compressed air from the discharge port. In this instance, as the outside air is compressed, the rotary vane 42 and the rotary shaft 2 are subjected to an axial force in the axial direction (direction given by arrow A). However, since axial displacement of the rotary shaft 2 is compensated for by the axial magnetic bearing, the influence by the axial force is eliminated, accordingly.

In the case where the centrifugal air compressor is used outdoors, at an ambient temperature of 0° C. or lower in particular, there may develop congelation F of moisture contained in the outside air in a narrow clearance between the rotary vane 42 and the inner wall of the pressure volute 41. This can result in firm adhesion of the rotary vane 42 to the pressure volute 41. As described previously, when the rotary vane 42 is adhered to the pressure volute 41, the starting performance of the compressor is adversely affected.

Figure 2:
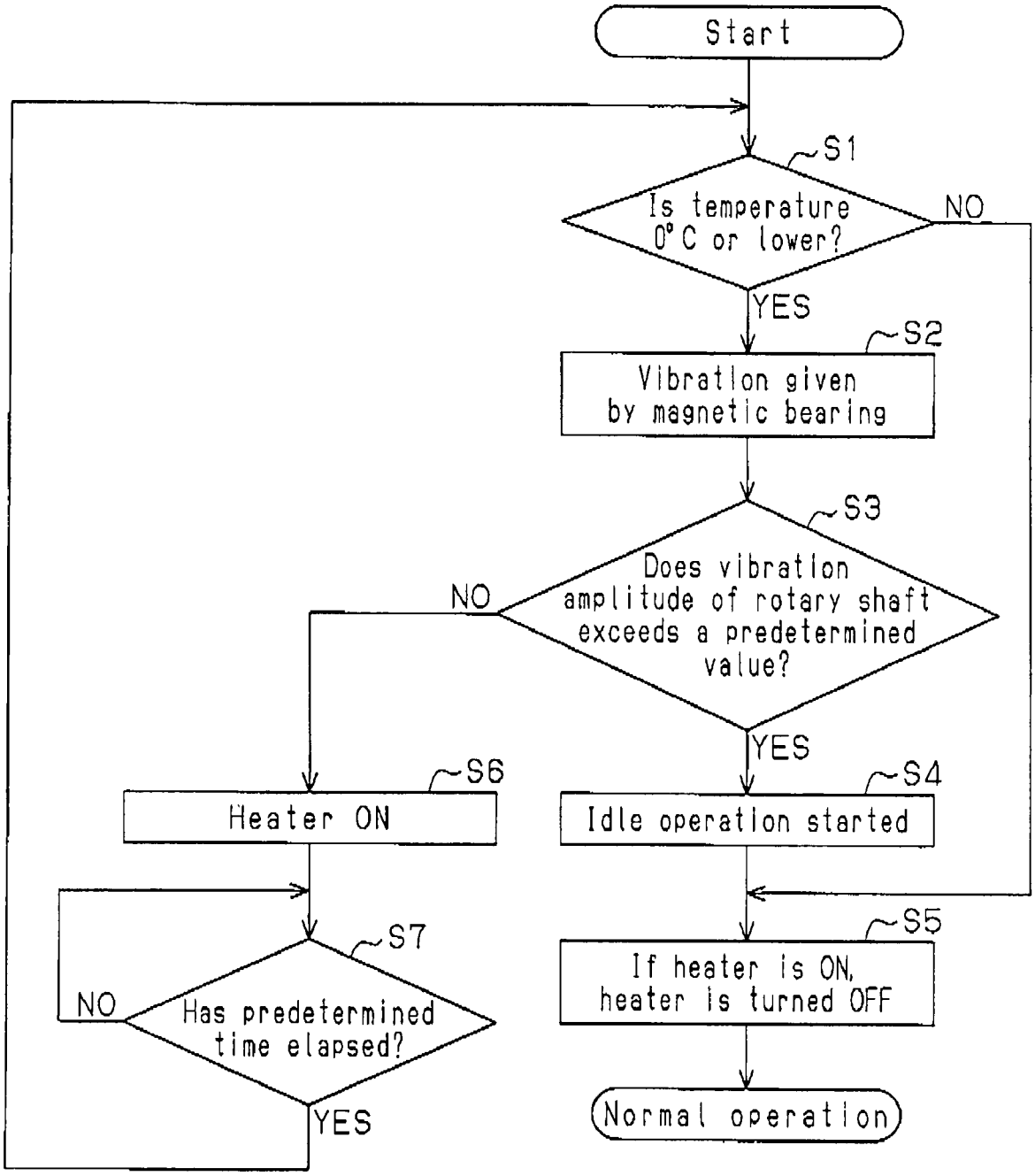
FIG. 2 is a flowchart showing a procedure of preliminary process executed at the time of starting up a compressor by using a controller.

Then, in the present embodiment, a heater 44 and a temperature sensor 45 are installed outside the pressure volute 41 constituting the compressor portion 4, and control as shown in FIG. 2 is executed by the controller 5.

In this control, whether the ambient temperature around the pressure volute 41 may develop congelation F, specifically whether the ambient temperature is 0° C. or lower, is checked during start-up by referring to an output signal from the temperature sensor 45 (Step 31). It the ambient temperature around the pressure volute 41 is not 0° C. or lower, it is determined that no congelation F has developed and the heater 44 is turned on. That is, if the heater 44 is operating, it is turned off (Step S5). Thereafter, the compressor is shifted to a normal operation.

If the ambient temperature is 0° C. or lower, an axial magnetic bearing is used to vibrate the rotary shaft 2 (Step S2) as shown by arrow B in FIG. 1. This vibration is easily given when the electromagnets 33*a*, 33*b* constituting the magnetic bearing are controlled by supplying electricity at a predetermined cycle under predetermined loading conditions. Then, the vibration amplitude of the rotary shaft 2 is measured on the basis of a signal outputted from the axial displacement sensor 34 (Step S3). If the vibration amplitude of the rotary shaft 2 exceeds a predetermined value, it is determined that no congelation F has developed from the beginning or that the adhesion due to the congelation F has been eliminated by the vibration of the rotary shaft 2, and the compressor is started in an idle operation (Step S4). In this instance, it the heater 44 is in operation, it is turned off (Step S5) and the compressor is started in a normal operation.

On the other hand, if the vibration amplitude of the rotary shaft 2 does not exceed a predetermined value, it is determined that the adhesion due to the congelation F is not eliminated and the heater 44 is turned on and starts generating heat (Step S6). After the heater 44 continues to generate heat for a predetermined time (Step S7: Yes), the ambient temperature is again measured on the basis of a signal outputted from the temperature sensor 45 (Step S1) and the above-described procedure is repeated.

In starting the centrifugal air compressor, the above-described preliminary process is executed, Thus, even if the rotary vane 42 is adhered to the pressure volute 41 due to the congelation F, the adhesion is reliably eliminated so that the compressor is can be started stably. Normally, the shortest distance between the inner wall of the pressure volute 41 and the rotary vane 42 is approximately 0.1 mm. Therefore, the rotary shaft 2 is vibrated at a vibration amplitude of 0.1 mm or less. Further, the axial magnetic bearing generates a force equal to the force that is axially applied to the rotary shaft 2 when air is compressed. Due to the above-described vibration, the axial magnetic bearing is normally capable of generating a force of about 20 Kg. As described above, the vibration amplitude at this time can be measured by using the axial displacement sensor 34. Therefore, no dedicated sensor for measuring the vibration amplitude is required. If the measured vibration amplitude exceeds the predetermined value, it is determined that no congelation F has developed from the beginning or the congelation F has been eliminated by vibration. However, since there is a possibility of congelation that has not reached adhesion, the compressor is idled first and then operated normally.

The following advantages are obtained according to the centrifugal air compressor of the present embodiment.

(1) Even if the rotary vane 42 is adhered to the pressure volute 41 due to the congelation F, the controller 5 first actuates the magnetic bearing so as to vibrate the rotary shaft 2 on start-up of a compressor. In view of the structural features of the magnetic bearing, vibration can be easily given to the rotary shaft by supplying electricity to a pair of electromagnets constituting the magnetic bearing at a predetermined cycle under predetermined loading conditions. Then, if the vibration is given to eliminate the adhesion of the rotary vane 42, in other words, if the rotary shaft 2 can be subjected to vibration at a predetermined or greater vibration amplitude, the compressor is operated instantly based on such determination. In contrast, if the adhesion of the rotary vane 42 is not eliminated even after the magnetic bearing is used to vibrate the rotary shaft, in other words, if the vibration amplitude of the rotary shaft 2 is lower than a predetermined amplitude, the controller 5 actuates the heater 44, Any congelation, even if it is rigid, will begin to thaw on actuation of the heater 44. Although depending on the condition of the heater 44, the adhesion of the rotary vane 42 due to the congelation F is eliminated in a relatively short time after actuation of the heater 44, thereby the vibration amplitude of the rotary shaft 2 of the thus given vibration exceeds a predetermined amplitude value. Then, when the vibration amplitude of the rotary shaft 2 of the thus given vibration exceeds a predetermined amplitude value, the operation of the compressor is instantly started based on such determination. If no adhesion due to congelation F exists at the time of starting up the compressor, the vibration amplitude of the rotary shaft 2 instantly exceeds the predetermined amplitude value in accordance with the thus given vibration, thereby the operation of the compressor is instantly started. As a result, even if the rotary vane 42 is adhered to the pressure volute 41 due to the congelation F, the adhesion of the rotary vane 42 is reliably eliminated so that the compressor is started stably.

(2) The compressor is additionally provided with the temperature sensor 45 for detecting the temperature of the pressure volute 41 or that in the vicinity thereof. Thus, in the case where the temperature detected by the temperature sensor 45 is 0° C. or lower, the starting performance of the compressor is further improved when the rotary vane 42 is not adhered or the adhesion thereof is eliminated on vibration of the rotary shaft 2 by the controller 5 or actuation of the heater 44. In other words, a congelation usually develops at an ambient temperature of 0° C. or lower. Therefore, the controller 5 may be used to vibrate the rotary shaft 2 and the heater 44 may be actuated when the vibration amplitude of the rotary shaft 2 is lower than a predetermined amplitude value when a temperature detected by the temperature sensor 45 is 0° C. or lower. In other words, if the temperature detected by the temperature sensor 45 exceeds 0° C., preliminary processes such as vibration given by the controller 5 to the rotary shaft 2 and actuation of the heater 44 are omitted, thus making it possible to start the compressor smoothly. In addition, for this purpose, the temperature sensor 45 and the heater 44 are added to the centrifugal air compressor having an ordinary type of axial magnetic bearing and also functions of performing the preliminary processes shown in FIG. 2 are added to the controller 5 for controlling an axial magnetic bearing and a motor.

(3) The radial foil bearings 31 are adopted as the bearing devices 3 to support the rotary shaft 2 in the radial direction, which is advantageous in terms of installation space and cost.

(4) Since the rotary shaft 2 is vibrated in the axial direction by way of the axial magnetic bearing, the adhesion is more effectively eliminated from the rotary vane 42. Further, the vibration amplitude of the thus vibrated rotary shaft 2 is detected by the axial displacement sensor 34 for monitoring the displacement of the rotary shaft 2 at the magnetic bearing. Therefore, the vibration amplitude of the rotary shaft 2 is more easily managed at the time of giving vibration.

In addition, the above embodiment may be modified as follows.

The radial foil bearings 31 may be replaced by radial magnetic bearings. In this instance, the radial magnetic bearings are used together with an axial magnetic bearing, thus making it possible to eliminate more effectively the congelation F. In other words, since various types of vibrations can be given to the rotary shaft 2 both in the axial and radial directions concurrently or alternately, the congelation F is more effectively eliminated from the rotary shaft 2 by the thus given vibrations. Further, in the constitution, the rotary shaft 2 may be vibrated by magnetic bearings in the radial direction or in the axial direction. In particular, the axial magnetic bearing for supporting the rotary shaft 2 along the axial direction in a non-contact manner is adopted, and if the axial magnetic bearing is used to vibrate the rotary shaft 2 along the axial direction, the adhesion is more effectively eliminated from the rotary vane 42 and the axial displacement sensor 34 is used to manage more easily the vibration amplitude of the rotary shaft 2 at the time of giving vibration. In this instance, a bearing mechanism more advantageous in terms of installation space, for example, a radial foil bearing may be adopted as the structure of a bearing for supporting a rotary shaft along the radial direction. In a combined use of the axial magnetic bearing with the radial magnetic bearings as magnetic bearings, vibrations by these two types of magnetic bearings are used to give vibration concurrently in the axial direction and the radial direction, thereby vibrating the rotary shaft 2.

In the illustrated embodiment, the heater 44 is used as heating means. However, also usable is heating means for directly heating at least one of the pressure volute 41 and the rotary vane 42 or heating means for heating indirectly. For example, means that blows warm air through the suction port 43 into the pressure volute 41 may be employed. As described in the illustrated embodiment, if the heater 44 for directly heating a part to which the pressure volute 41 and the rotary vane 42 are brought closer is mounted on the pressure volute 41, the part can be heated more effectively and consequently thawed more easily. In other words, it is possible to satisfy such conditions more easily that the vibration amplitude of the rotary shaft 2 from vibrations exceeds a predetermined amplitude value at the time of congelation.

In the illustrated embodiment, the temperature sensor 45 may be omitted in view of a reduction in manufacturing cost as long as heating means such as the heater 44 is actuated when the vibration of the rotary shaft 2 is lower than a predetermined amplitude, and the compressor is actuated on the basis of the fact that the vibration amplitude of the rotary shaft 2 exceeds a predetermined amplitude value. In this instance, if adhesion is not found at the time of starting up the compressor, the vibration amplitude of the rotary shaft 2 instantly exceeds a predetermined amplitude value in accordance with the thus given vibration, thereby the compressor is also instantly actuated. An amplitude value at the time of giving vibration to the rotary shaft 2 can be measured and managed by using a displacement sensor constituting a magnetic bearing. This is cost-advantageous in terms of the constitution of the compressor. Further, a special vibration amplitude sensor such as a magnetic sensor may be used as a displacement sensor.

INDUSTRIAL APPLICABILITY

The centrifugal air compressor of the present invention may be widely used as a compressor usable in an environment where the rotary vane 42 may be adhered to the pressure volute 41 due to a congelation. In particular, the centrifugal air compressor can be used outdoors, for example as an on-vehicle compressor and a compressor of a radiator and a refrigerator/freezer.

The invention claimed is:

1. A centrifugal air compressor comprising:

a rotary shaft supported by a magnetic bearing having electromagnets;

a rotary vane connected to the rotary shaft;

a pressure volute for encompassing the rotary vane and also compressing air; and a suction port for drawing air into the pressure volute, wherein air drawn in through the suction port into the pressure volute is compressed by rotation of the rotary vane, the centrifugal air compressor further comprising:

a heater configured and positioned to heat at least one of the pressure volute and the rotary vane; and a controller configured for controlling energization of the electromagnets of the magnetic bearing, prior to the time of starting the operation of the centrifugal air compressor, to vibrate the rotary shaft, and having means for starting the operation of the centrifugal air compressor in response to a determination that the vibration amplitude of the rotary shaft, due to vibrations resulting from the control of the electromagnets to vibrate the rotary shaft, exceeds a predetermined amplitude value.

2. The centrifugal air compressor according to claim 1, wherein the heater is mounted on the pressure volute, and wherein the heater heats a part at which the pressure volute and the rotary vane are brought close to each other.

3. The centrifugal air compressor according to claim 1, wherein the magnetic bearing is provided with a displacement sensor for monitoring displacement of the rotary shaft, and wherein the displacement sensor detects the vibration amplitude of the rotary shaft to which the vibration is given.

4. The centrifugal air compressor according to claim 1, wherein the magnetic bearing comprises an axial magnetic bearing for supporting the rotary shaft along the axial direction in a non-contact manner, and wherein the controller gives vibration along the axial direction to the rotary shaft by way of the axial magnetic bearing.

5. The centrifugal air compressor according to claim 1, further comprising a temperature sensor for detecting a temperature of the pressure volute or the vicinity thereof, wherein the controller controls energization of the electromagnets of the magnetic bearing to vibrate the rotary shaft responsive to a determination that the temperature detected by the temperature sensor is 0° C. or lower.

6. The centrifugal air compressor according to claim 1, wherein the controller includes means for actuating the heater in response to a determination that the vibration amplitude of the rotary shaft, due to vibrations resulting from the control of the electromagnets to vibrate the rotary shaft, is lower than a predetermined amplitude value.

* * * * *